US007993466B2

(12) United States Patent
Aude

(10) Patent No.: US 7,993,466 B2
(45) Date of Patent: Aug. 9, 2011

(54) MATERIAL JET SPRAY HEAD CLEANING

(75) Inventor: Olivier Aude, Marseilles (FR)

(73) Assignee: Gemalto SA, Meudon (FR)

( * ) Notice: Subject to any disclaimer, the term of this patent is extended or adjusted under 35 U.S.C. 154(b) by 1745 days.

(21) Appl. No.: 10/496,101

(22) PCT Filed: Nov. 28, 2002

(86) PCT No.: PCT/FR02/04086

§ 371 (c)(1),
(2), (4) Date: May 19, 2004

(87) PCT Pub. No.: WO03/045697

PCT Pub. Date: Jun. 5, 2003

(65) Prior Publication Data

US 2005/0072447 A1 Apr. 7, 2005

(30) Foreign Application Priority Data

Nov. 30, 2001 (FR) ..... 01 15519

(51) Int. Cl.
*B08B 7/04* (2006.01)

(52) U.S. Cl. ..... 134/6; 134/137; 134/9; 134/15; 134/38; 438/21

(58) Field of Classification Search ..... 134/6, 137, 134/15, 38; 239/104, 106, 114, 115, 123
See application file for complete search history.

(56) References Cited

U.S. PATENT DOCUMENTS

| | | | | |
|---|---|---|---|---|
| 4,571,601 | A | 2/1986 | Teshima | |
| 4,829,318 | A | 5/1989 | Racicot et al. | |
| 4,928,120 | A | 5/1990 | Spehrley, Jr. et al. | |
| 5,449,754 | A | 9/1995 | Nishioka | |
| 5,757,387 | A * | 5/1998 | Manduley | 347/2 |
| 5,969,731 | A * | 10/1999 | Michael et al. | 347/33 |
| 6,286,828 | B1 * | 9/2001 | Adema | 271/186 |
| 6,312,090 | B1 * | 11/2001 | Griffin et al. | 347/28 |
| 6,422,772 | B1 * | 7/2002 | Fisher et al. | 400/629 |
| 2002/0101462 | A1 * | 8/2002 | Therien | 347/1 |

FOREIGN PATENT DOCUMENTS

| | | |
|---|---|---|
| FR | 2 790 421 | 9/2000 |
| WO | 99/19900 | 4/1999 |

* cited by examiner

*Primary Examiner* — Michael Cleveland
*Assistant Examiner* — Samuel A Waldbaum
(74) *Attorney, Agent, or Firm* — Buchanan Ingersoll & Rooney PC

(57) ABSTRACT

In a method for cleaning a material jet spray head having outside material jet spray cycles, an absorbent member and a wiper are positioned so that at least a section of the absorbent member is interposed between the wiper member and a material outlet device. The absorbent member and the wiper member thus form a cleaning assembly. Relative displacement between the cleaning assembly and the material outlet device occurs along a cleaning plane substantially perpendicular to the elevation direction so that the wiper member scrapes the material outlet device substantially simultaneously with absorption by the absorbent member.

23 Claims, 5 Drawing Sheets

MATERIAL JET SPRAY HEAD CLEANING

This disclosure is based upon French Application No. 01/15519, filed Nov. 30, 2001, and International Application No. PCT/FR02/04086, filed Nov. 28, 2002, the contents of which are incorporated herein by reference.

BACKGROUND OF THE INVENTION

The invention concerns the cleaning of material jet heads as well as the machines and manufacturing equipment equipped with self-cleaning material jet heads.

"Material jet heads" means here both tinctorial inkjet printing heads and heads for spraying liquids or viscous or powdery products.

In addition, the fields to which the invention applies relate, beyond tinctorial printing with inks, the material jet having medical, biological, genetic, chemical, acoustic, insulating or electrically conductive functions or properties, or the like.

For example, the document WO-A-9919900 shows various uses of the material jet, apart from printing.

The devices employing material jet heads are used for spraying drops of material on a substrate so as to form an image or a three-dimensional structure.

The document FR-A-2790421, filed in the name of the applicant, describes a graphical material jet machine provided with at least one inkjet head.

This document supplies an example of the use of material jet heads for printing patterns on a support such as a chip card.

The document U.S. Pat. No. 5,449,754 describes a method of producing chemical compounds by spraying drops of various liquid solutions onto a substrate.

This document supplies an example of the use of material jet heads for an application in chemistry.

The methods and devices for spraying droplets of material have the characteristic of being sensitive to clogging of the material outlet orifices.

This is because these orifices have a diameter of around a few tens of microns and because of this the least impurity may interfere with the jet of material.

In addition, because of their function of spraying material, these orifices are highly susceptible to being blocked by residues of dry material after use.

Periodic cleaning devices for material jet heads have therefore been developed.

In particular, it is known how to provide a purge phase during which a large quantity of material is expelled through the outlet orifices, a receptacle also being provided to collect the purged material.

This solution has a certain number of drawbacks, including the difficulty of making the receptacle/orifices assembly liquidtight, the receptacle being removable. Moreover, the risk of running is significant in the case of a material jet head which can take various positions.

It is also known how to provide a rubber scraper able to scrape the material outlet orifices during a cleaning phase so as to remove the residual drops of material.

This type of device does not currently give satisfaction because of the difficulty in recovering the scraped material and the need for periodic cleaning of the scraper itself.

It is also known how to provide phases of cleaning the material jet heads by disposing a ribbon under the material jet head, pressing it against the material outlet orifices by means of a pad; and then causing it to move so as to wipe these orifices.

This solution, although more satisfactory than the previous ones, does not leave a sufficiently clean surface state for a quality material jet.

SUMMARY OF THE INVENTION

The invention remedies these drawbacks, in particular by supplying a simple cleaning making it possible to ensure a perfect state of cleanliness compatible with the requirements of the precision material jet and/or high rates without using a complex and expensive mechanism.

To this end, a first object of the invention relates to a method of cleaning at least one material jet head of the type comprising an outlet device for material to be sprayed; this method comprising, outside any jet of material through this head, a cleaning cycle comprising the steps making provision for:

a) providing an absorbent member able to absorb the material and disposed in accordance with a first geometric relationship in space with respect to the material outlet device;

b) providing a scraper member disposed in a second geometric relationship in space with respect to the material outlet device and the absorbent member;

c) reaching a position, referred to as the start of cleaning position, in which at least one portion of the absorbent member is interposed between the scraper member and the material outlet device, the absorbent member and the scraper member thus forming a cleaning assembly;

d) causing a relative movement in a cleaning plane substantially perpendicular to the elevation direction, between the cleaning assembly and the material outlet device, so that the scraper member scrapes the material outlet device substantially simultaneously with an absorption by the absorbent member.

The material jet head can belong to the group formed by inkjet printing heads, heads for spraying viscous liquids, dispensing systems and the like.

The material sprayed may belong to the group formed by tinctorial, medical, biological, genetic, chemical, conductive or electrically insulating substances and the like.

The material outlet device mentioned may comprise at least one material outlet orifice.

Moreover, in the first geometrical relationship mentioned, the absorbent member may be generally flat in shape and be disposed in the cleaning plane, opposite the material outlet device.

Likewise, in the second geometrical relationship, the scraper member may be disposed so that the absorbent member is positioned between the material outlet device and the scraper member.

In one embodiment, at step c), the cleaning device is formed by pressing the scraper member and the absorbent member against the material outlet device.

In another embodiment, the cleaning method also comprises, after step b), a purge cycle comprising the steps making provision for:

b1) applying the absorbent member against the material outlet device;

b2) moving the absorbent member in the cleaning plane relative to the material outlet device and simultaneously expelling material continuously through the material outlet device for a predetermined period;

b3) separating the absorbent member from the material outlet device in the elevation direction.

Also in one embodiment, the cleaning method also comprises, after step b), a jet cycle comprising the steps making provision for:

b1) disposing the absorbent member close to the material outlet device;

b2) executing jets of material at isolated points through the material outlet device, at regular intervals during the period of the jet cycle.

A second object of the invention relates to a system for cleaning a material jet head comprising a material outlet device, this device comprising:

an absorbent member able to absorb the material and disposed in a first geometric relationship in space with respect to the material outlet device;

a scraper member disposed in a second geometric relationship in space with respect to the material outlet device and the absorbent member;

first means of moving the scraper member in translation in the cleaning plane;

second means of moving the scraper device in the elevation direction between a position in which it is separated from the material outlet device and a position in which it is pressed against the absorbent member and the material outlet device;

third means of moving the absorbent member in the cleaning plane relative to the material outlet device;

fourth means of moving the absorbent member in the elevation direction between a position in which it is separated from the material outlet device and a position in which it is held against the material outlet device;

means of controlling the first, second, third and fourth movement means in at least one cleaning cycle in which substantially simultaneously the scraper device scrapes the material outlet device whilst the absorbent member absorbs the material thus scraped.

In the first geometric relationship mentioned, the absorbent member may be generally flat in shape and be disposed in the cleaning plane, opposite the material outlet device.

Likewise, in the second geometric relationship mentioned, the scraper member may be disposed so that the absorbent member is positioned between the material outlet device and the scraper member.

The first movement means can comprise a runner allowing the translation of the scraper member in the direction of movement of the absorbent member.

The second movement means can comprise an actuator with electromagnet.

In one embodiment, the absorbent member is in the form of a ribbon of absorbent material and the third movement means comprise a payout reel and a winding reel as well as two guide spindles, these two reels being able to cooperate in order to make the ribbon of absorbent material pass between the two guide spindles.

The fourth movement means can comprise at least one runner allowing the translation in the elevation direction of at least one of the guide spindles.

In a variant, the fourth movement means can comprise at least one eccentric allowing the translation in the elevation direction of at least one of the guide spindles.

In a preferred embodiment, the control means are able to provide a cleaning cycle during which:

the fourth movement means are controlled so as to keep the absorbent member separated from the material outlet device;

the third movement means are controlled so as to move the absorbent member in the cleaning plane relative to the material outlet device;

the second movement means are controlled so as to press the scraper member against the absorbent member and the material outlet device.

In addition, the control means can be able to provide a purge cycle during which:

the fourth movement means are controlled so as to hold the absorbent member against the material outlet device;

the third movement means are controlled so as to move the absorbent member in the cleaning plane relative to the material outlet device;

the second movement means are controlled so as to hold the scraper member separated from the material outlet device.

Likewise, the control means can be able to provide a jet cycle during which:

the fourth movement means are controlled so as to keep the absorbent member separated from the material outlet device;

the second movement means are controlled so as to keep the scraper member separated from the material outlet device.

A third object of the invention relates to a material jet machine functioning in particular according to the cleaning method in accordance with the invention, and/or comprising a cleaning system according to the invention, this machine comprising:

a material jet head comprising at least one material outlet orifice;

means of controlling the material jet function of the material jet head;

purge means;

the purge means being arranged so as to open out via the material outlet device against the absorbent material, so that the material to be sprayed issuing from a reservoir and/or from the material outlet device is recovered by this absorbent member.

In one embodiment, the purge means are able, during the cleaning system purge cycle, to control the expulsion of material continuously by the material outlet device for a predetermined period.

In another embodiment, the means of controlling the material jet function are able, during the jet cycle of the cleaning system, to control the isolated execution of the jets of material through the material outlet device at regular intervals during the jet cycle period.

A fourth object of the invention relates to equipment for manufacturing a structure such as an electronic device, this equipment;

provides cleaning according to the method according to the invention; and/or comprises a cleaning system according to the invention; and/or comprises a machine according to the invention.

A fifth object of the invention relates to a process of manufacturing a structure such as an electronic device, for example an intelligent portable object or electronic component, an information medium, for example an optical or magnetic disc, or the like, characterised in that this manufacture:

provides for a cleaning according to the method in accordance with the invention; and/or uses a cleaning system according to the invention; and/or is in particular manufactured on a machine according to the invention; and/or is in particular manufactured on an item of equipment according to the invention.

BRIEF DESCRIPTION OF THE DRAWINGS

Other characteristics and advantages of the invention will emerge in the light of the following description relating to the accompanying drawings, given by way of example.

DETAILED DESCRIPTION

In the orthogonal reference frames accompanying the figures, the longitudinal direction is represented by the X-axis, the transverse direction is represented by the Y-axis and the elevation direction is represented by the Z-axis.

Figure 1:
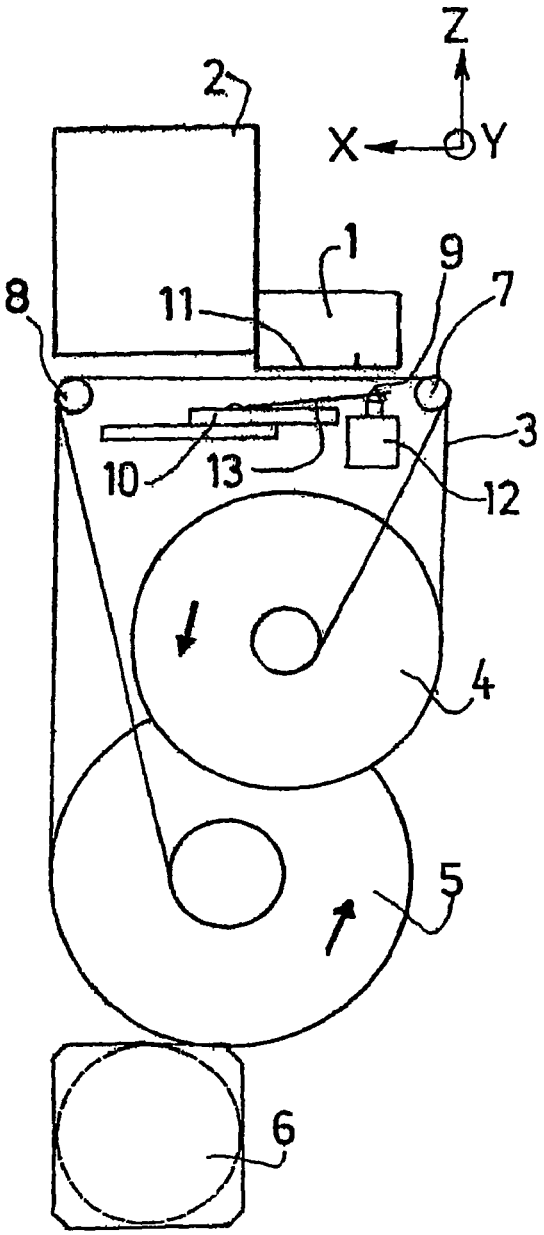
FIG. 1 is a schematic side view of a material jet machine according to the invention.

FIG. 1 depicts schematically a material jet machine seen from the side, equipped with a cleaning system according to the invention. only the elements participating in the cleaning phases have been shown.

The machine comprises a material jet head with a material jet 1 supplied by a material reservoir 2. This head is able to move in the transverse direction Y so as to be able to reach the material jet zones on the machine and to be able to be placed above the cleaning system during the cleaning phases as depicted in FIGS. 1 to 5.

This is because the cleaning system is fixed on one side of the material jet machine, on a transverse movement path (in the transverse direction Y) of the material jet head.

The material jet head comprises a substantially plane nozzle plate 11 containing a plurality of material outlet orifices.

The cleaning system comprises a ribbon 3 of absorbent material with a width greater than that of the material jet head 1 (see FIG. 3) and able to move under this through the action of a payout reel 4 and a winding reel 5, the latter being moved by a motor 6 and transmission means.

The ribbon 3 can have a width (in the transverse direction Y) of 80 mm and a thickness of 0.25 mm, a new payout reel 4 can have a diameter of 70 mm corresponding to a full winding reel diameter 5 of 75 mm, the distance between axes of the reels 4, 5 then being 54 mm.

The ribbon 3 is positioned and guided by two rollers 7, 8 mounted so as to rotate and disposed parallel to the transverse direction Y so as to keep substantially flat a portion of ribbon 3 tensioned under the material jet head 1.

These rollers 7, 8, forming guidance axes, are moreover able to move in the elevation direction. They are mounted on means of translation in the elevation direction Z such as runners or eccentrics, a device for controlling these translation means then allowing the positioning in the elevation direction Z of the portion of ribbon 3 situated between the axes 7, 8.

The rotation of the axis of the payout reel 4 is controlled with respect to the control of the motor 6 so as to afford resistance to the unwinding of the reel 4 in order to keep the tension of the ribbon 3 between the guidance axes 7, 8 and provide a return effect.

In addition, the rotation of the reels 4, 5 is controlled, for example by virtue of a coding wheel, so as to detect any incident such as the breakage of the ribbon 3 or the failure of the motor 6, the purge operation not being performed in the event of detection of such an incident.

The motor 6 also has a control intended to control the speed of rotation of the reel 5 so that the speed of movement of the ribbon 3 remains constant whatever the length of the ribbon 3 wound on the reel 5, the information concerning the instantaneous diameter of the reel 5 being given by any appropriate means, for example a distance meter, a mechanical shoe or a potentiometer.

Figure 2:
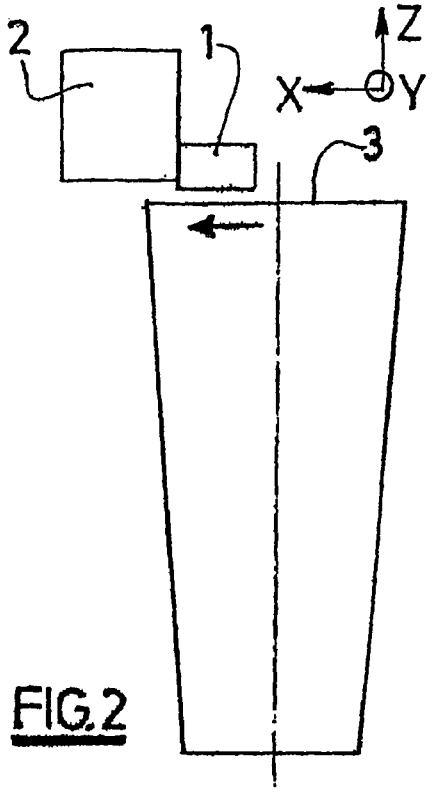
FIG. 2 is a schematic view similar to FIG. 1.
Figure 3:
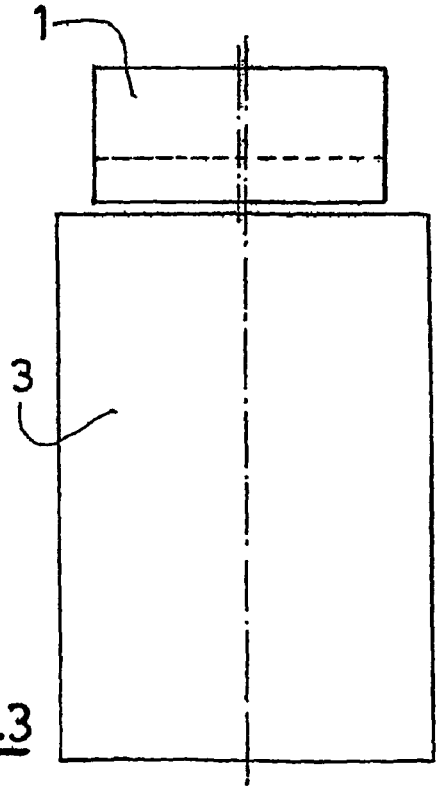
FIG. 3 is a front view corresponding to FIG. 2.

The mechanism of the rollers 4, 5 described makes it possible to make the ribbon 3 pass continuously under the nozzle plate 11, as depicted schematically in FIG. 2.

Under the portion of the ribbon 3 tensioned between the two rollers 7, 8, there is disposed a rubber scraper 9 mounted on a runner 10 enabling the scraper 6 to move in translation along the longitudinal direction X over a distance greater than the length (in the longitudinal direction X) of the nozzle plate 11.

In addition, the scraper 9 extends transversely to the material jet head 1, in the transverse direction Y over a width at least equal to that of the nozzle plate 11.

The scraper 9 is also controlled by an actuator 12 with an electromagnet fixed to the runner 10 and able to press the scraper 9 against the nozzle plate 11 when it is actuated, the scraper 9 being kept separated from the nozzle plate 11 by a spring 13 when the actuator 12 is in the idle state.

The actuator 12 puts the scraper 9 in contact with the nozzle plate 11 with, for example, the following characteristics:

thrust force: 12 N return force to the idle position: 1.5 N possibility of adjustment of the pressure exerted on the scraper minimum travel: 4 mm.

The material jet head is also provided with a purge device arranged so as to put the material reservoir 2 under pressure and thus force the material to emerge continuously through the material outlet orifices, thus providing a purge of the material jet circuit.

The cleaning system described functions as indicated below.

During material jet phases, the material jet head moves parallel to the transverse direction Y, above the substrate to be printed.

During cleaning phases, the material jet head comes to be placed at the end of travel of the transverse direction Y so as to come to be positioned on the side of the machine where the cleaning system is disposed, above the ribbon 3' (as depicted in FIG. 1).

At this stage, the cleaning system is in the idle state, that is to say the scraper 9 is kept separated from the ribbon 3 by the spring 13, the guidance axes 7, 8 are disposed in the elevation direction Z so as to keep the portion of ribbon 3 situated between them at a distance of around 2 mm from the nozzle plate 11.

The cleaning system can then be controlled according to various cycles described with reference to FIGS. 6 to 10 in which, on the Y axis, the time is entered and on the X axis the states (actuated or idle) of the following various members are entered:

ribbon contact control Cl;

scraper control C2;

motor control C3;
purge control C4;
piezoelectric control C5.

Figure 6:
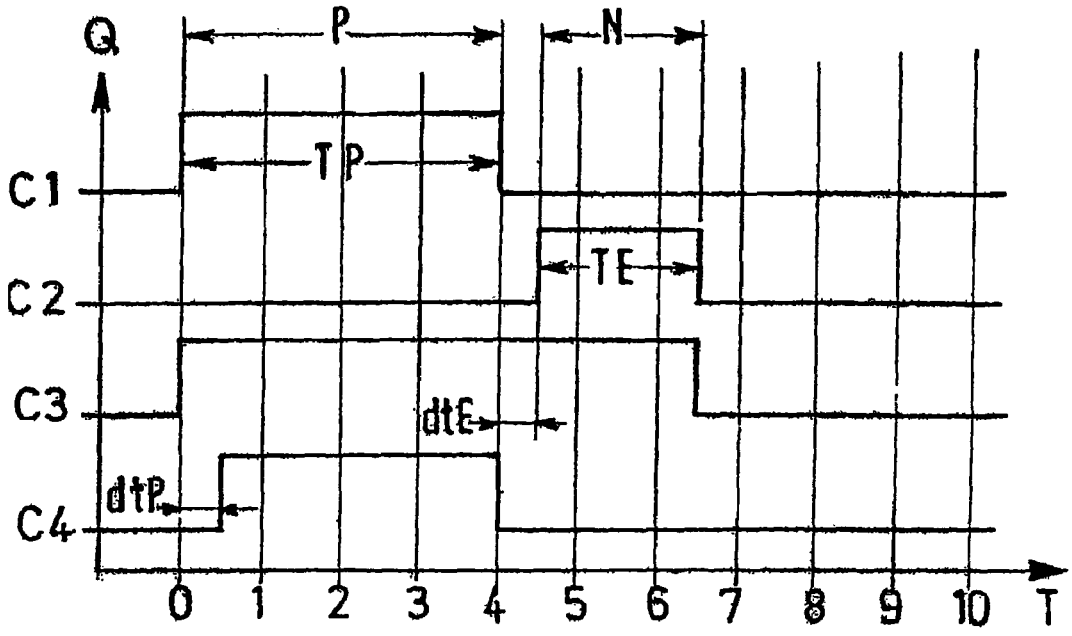
FIG. 6 is a diagram of the purge and cleaning cycles according to the invention.

FIG. 6 depicts a cleaning sequence comprising first of all a purge cycle P during which:

the ribbon contact C1 is activated, that is to say the guide axes 7, 8 are moved in translation so as to press the ribbon 3 against the nozzle plate 11;
the scraper control C2 is deactivated, that is to say the scraper 9 is in a position away from the ribbon 3, the actuator 12 being in the idle position;
the motor control C3 is activated, that is to say the motor 6 is started so as to make the ribbon 3 move;
the purge control C4 is activated, creating a flow of material through the nozzle plate 11.

The material produced by the purge operation is thus absorbed by the ribbon 3 passing at a sufficient speed so that no running occurs.

Figure 4:
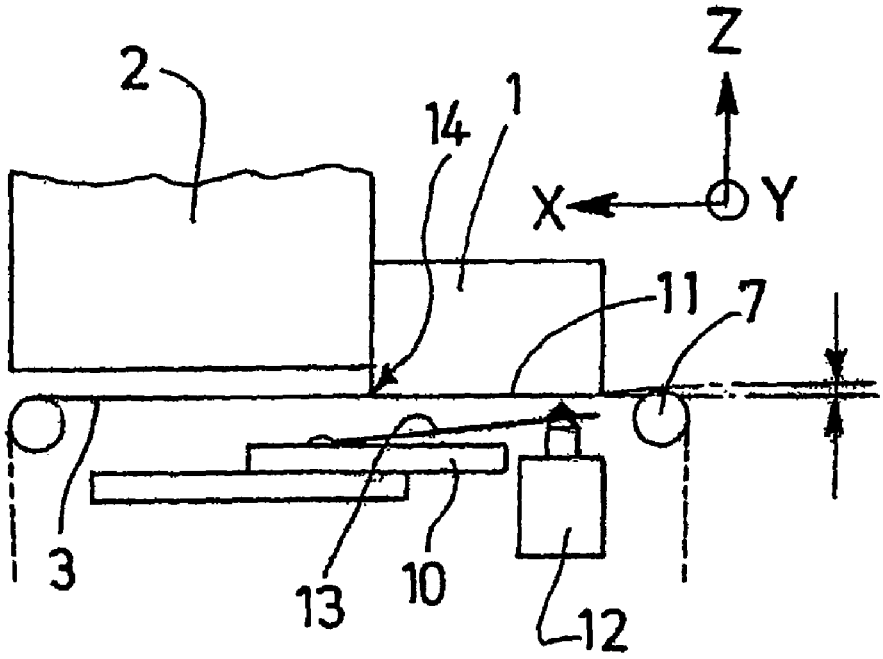
FIG. 4 is a schematic view of a cleaning system according to the invention.

With reference to FIG. 4, the ribbon is preferably put in contact with the nozzle plate 11 by positioning the guide axes 7, 8 in the elevation direction Z in the following manner:

the highest point in terms of Z of the axis downstream of the direction of travel of the ribbon 3 (the axis 8) is positioned at the same height as the plane formed by the nozzle plate 11;
the highest point in terms of Z of the axis upstream of the direction of travel of the ribbon 3 (the axis 7) is positioned approximately 2 mm above the plane formed by the nozzle plate 11.

Figure 5:
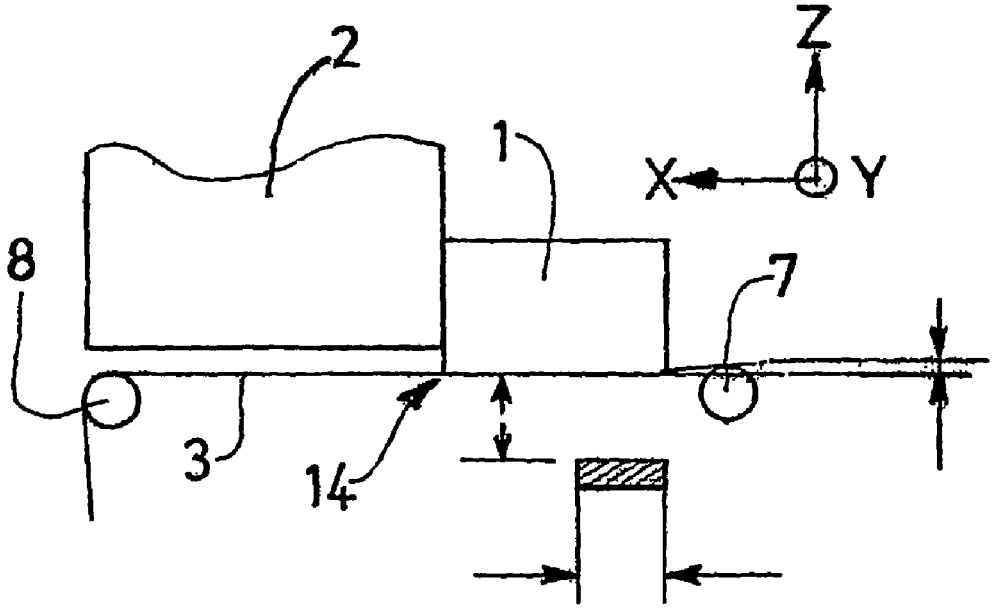
FIG. 5 is a view similar to FIG. 4.

Contact of the ribbon 3 against the entire surface of the nozzle plate 11 is thus ensured, avoiding, during the purge, the accumulation of material at the reference 14 in FIGS. 4 and 5.

The cleaning sequence in FIG. 6 comprises, following the purge cycle P, a cleaning cycle N during which:

the ribbon contact C1 is deactivated;
the scraper control C2 is activated;
the motor control C3 is activated;
the purge control C4 is deactivated.

During this cleaning cycle N, the ribbon 3 is in a position away from the nozzle plate 11 whilst the scraper 9 raises a linear portion against the nozzle plate 11. A cleaning member is thus formed since the linear portion (in the transverse direction Y) of the ribbon 3 formed by the pressure of the scraper 9 constitutes a scraper coated with absorbent material.

The motor control C3 being activated, the ribbon 3 passes under the nozzle plate 11 and the scraper 9, which is mounted in free translation on the runner 10 and which is in contact with the ribbon 3, is then driven in translation so that the cleaning member passes over the entire length (along X) of the nozzle plate 11, thus providing optimum cleaning.

Figure 7:
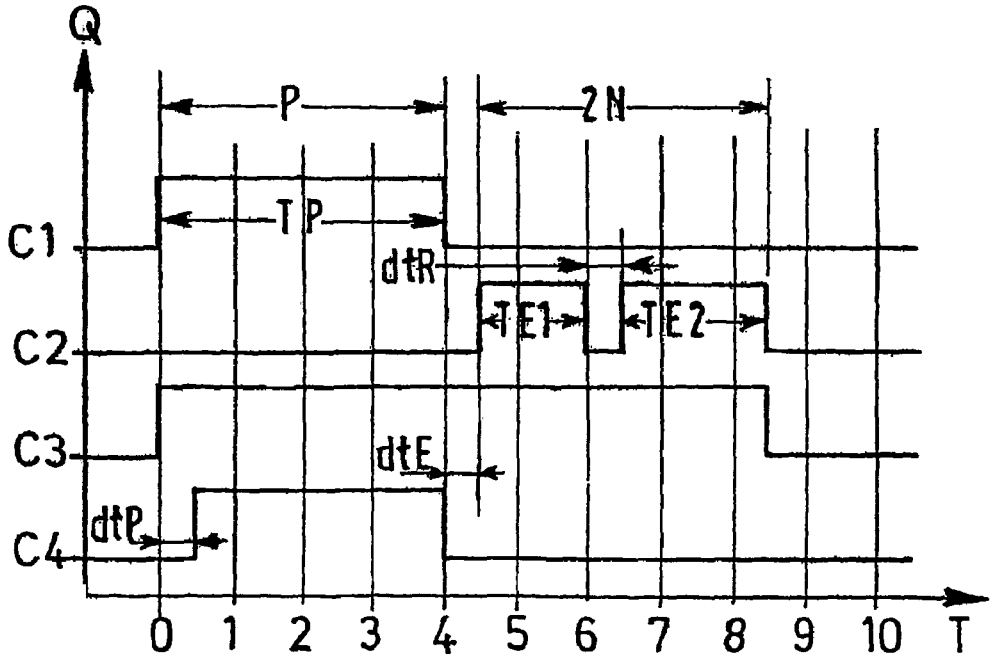
FIG. 7 is a diagram of the purge and double cleaning cycles according to the invention.

FIG. 7 depicts another cleaning sequence comprising first of all a purge cycle P as described previously and, following this, a double cleaning cycle 2*n* comprising a first cleaning TE1, similar to the cleaning cycle N described previously, followed by a second cleaning TE2 with, between these two cleanings, a control of the runner 10 providing a return of the scraper 9 into the initial position (the one depicted in FIGS. 1 and 4).

Figure 8:
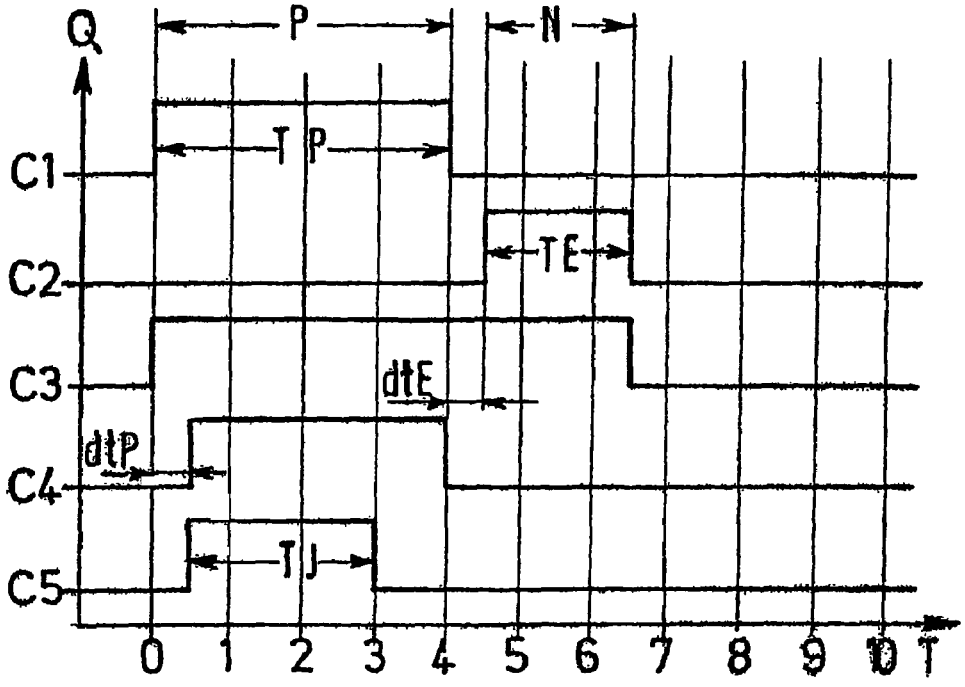
FIG. 8 is a diagram of the purge/material jet and cleaning cycles according to the invention.

Another embodiment of the invention is depicted by FIG. 8, illustrating a cleaning sequence comprising a purge cycle P combined with an activation of the piezoelectrics C5 followed by a cleaning cycle N like the one in FIG. 6.

This purge cycle P combined with an activation of the piezoelectrics C5 corresponds to the following states:

the ribbon contact C1 is activated;
the scraper control C2 is deactivated;
the motor control C3 is activated;
the purge control C4 is activated;
the piezoelectric control C5 is activated, that is to say the piezoelectric components responsible for the material jet function of the material jet head are started up, such as during a jet of material on a substrate.

Figure 9:
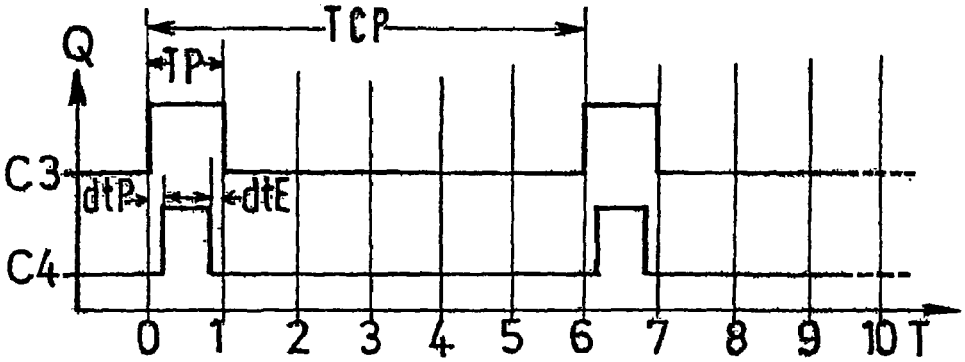
FIG. 9 is a diagram of the purge cycles according to the invention.

FIG. 9 for its part depicts a cleaning sequence comprising, at regular intervals TCP, a succession of purge cycles during which:

the motor control C3 is activated;
the purge control C4 is activated, the ribbon 3 being in position against the nozzle plate 11 when the purge is activated.

Figure 10:
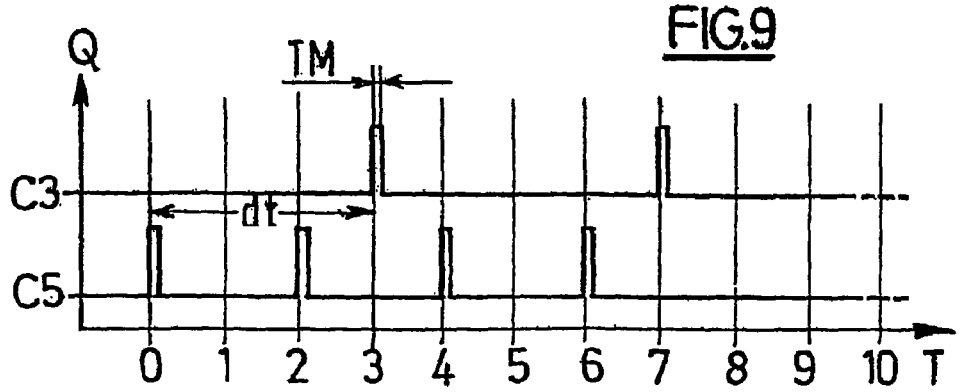
FIG. 10 is a diagram of the material jet cycles according to the invention.

FIG. 10 depicts another cleaning sequence comprising a cycle of jets during which:

the motor control C3 is activated for a time TM, at regular intervals;
the piezoelectric control C5 is activated at regular intervals.

The ribbon 3 is in a position away from the nozzle plate 11 during these operations and fulfils the role of a material jet substrate, this sequence making it possible to keep the material jet heads in a functioning state when the material jet is stopped in order to guarantee their immediate restarting when the material jet is resumed.

FIGS. 11A to 11D illustrate another embodiment of a cleaning cycle according to the invention. In these figures, the material jet head 11, the scraper 9, the ribbon 3 and the axes 7, 8 have been shown schematically.

In this embodiment, the arrangement of the elements is as follows:

the ribbon 3 passes under the material jet head 1 in the opposite direction to that in FIGS. 1 to 5;
the axis 7 is fixed in the elevation direction Z, its highest point in terms of Z being at the same height as the plane containing the nozzle plate 11;
the axis 8 is able to move in the elevation direction Z.

Figure 11A:
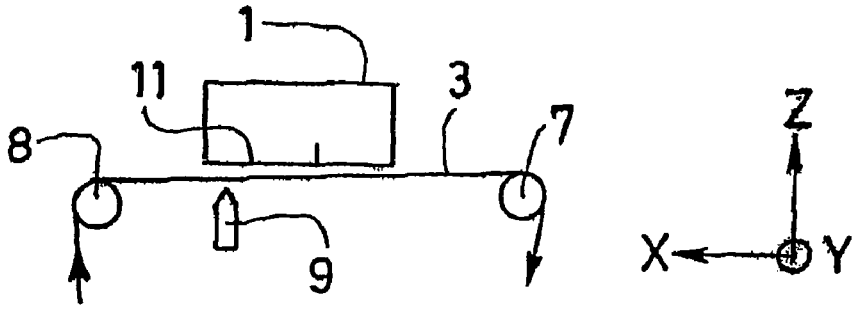
FIGS. 11A to 11D depict four steps of a cleaning cycle according to the invention.

FIG. 11A depicts the first step of the cleaning cycle, the axis 8 keeping the ribbon 3 away from the nozzle plate 11 and the scraper being in the initial position.

Figure 11B:
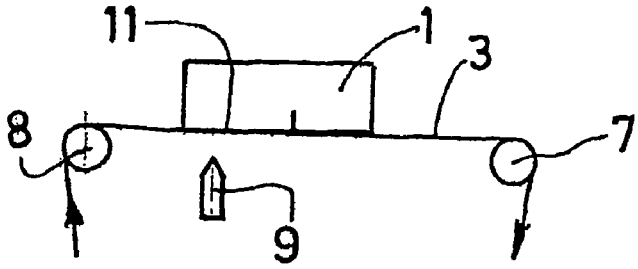

FIG. 11B shows the second step in which the axis 8 is positioned so as to press the ribbon 3 against the nozzle plate 11.

Figure 11C:
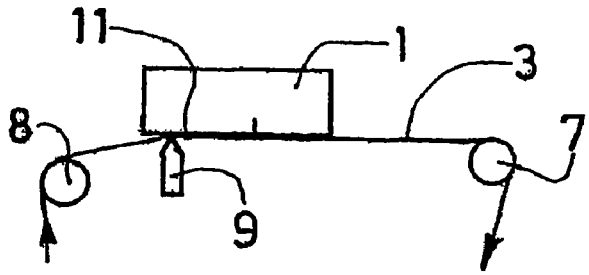
Figure 11D:
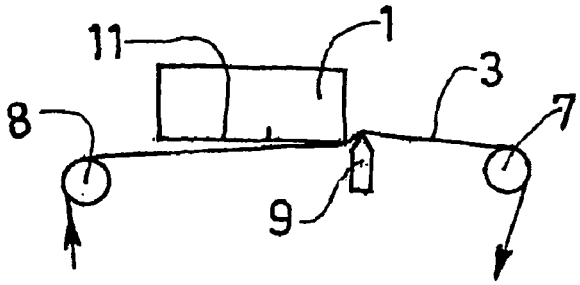

In FIG. 11C, the scraper 9 is controlled so as to come against the nozzle plate 11 and the axis 8 resumes its initial position. The movement of the scraper 9 in the longitudinal direction X is then initiated and FIG. 11D shows the scraper 9 at the end of its travel.

The invention claimed is:

1. A method of cleaning at least one material jet head having an outlet device for material to be sprayed; comprising the following steps:

a) providing an absorbent member that is able to absorb the material and that is disposed in accordance with a first geometric relationship in space with respect to the material outlet device;
b) providing a scraper member comprising a blade, said scraper member disposed in a second geometric relationship in space with respect to the material outlet device and the absorbent member;
c) positioning the material outlet device, the absorbent member and the scraper member relative to one another so that at least one portion of the absorbent member is interposed between the scraper member and the material outlet device, whereby the absorbent member and the scraper member form a cleaning assembly;
d) causing a relative movement between the cleaning assembly and the material outlet device in a cleaning plane substantially perpendicular to the elevation direction, so that the scraper member moves and scrapes the material outlet device substantially simultaneously with a movement and absorption by the absorbent member, wherein the scraper member undergoes a translation movement in the direction of movement of the absorbent member;

wherein the method further comprises, after step b), a purge cycle comprising the following steps: b1) applying the absorbent member against the material outlet device; b2) moving the absorbent member in the cleaning plane relative to the material outlet device and simultaneously expelling material continuously through the material outlet device for a predetermined period; b3) separating the absorbent member from the material outlet device in the elevation direction.

2. A cleaning method according to claim 1, wherein the material jet head belongs to the group formed by inkjet printing heads, viscous liquid spray heads, and dispensing systems.

3. A cleaning method according to claim 1, wherein the material sprayed belongs to the group formed by tinctorial, medical, biological, genetic, chemical, electrically conductive and insulating substances.

4. A cleaning method according to claim 1, wherein the material outlet device comprises at least one material outlet orifice.

5. A cleaning method according to claim 1, wherein in the first geometric relationship, the absorbent member has a generally flat shape and is disposed in the cleaning plane, opposite the material outlet device.

6. A cleaning method according to claim 1, wherein, in the second geometric relationship, the scraper member is disposed so that the absorbent member is positioned between the material outlet device and the scraper member.

7. A cleaning method according to claim 1, wherein, at step c), the cleaning assembly is formed by pressing the scraper member and absorbent member against the material outlet device.

8. A process of manufacturing at least one of an electronic device, and an information medium, and including a method for a cleaning according to claim 1.

9. A system for cleaning a material jet head having a material outlet device comprising:

an absorbent member that is able to absorb the material and that is disposed in a first geometric relationship in space with respect to the material outlet device;

a scraper member comprising a blade, said scraper member disposed in a second geometric relationship in space with respect to the material outlet device and the absorbent member;

first means for moving the scraper member in translation in a cleaning plane;

second means for moving the scraper device in an elevation direction between a position in which it is separated from the material outlet device and a position in which it is pressed against the absorbent member and the material outlet device;

third means for moving the absorbent member in the cleaning plane relative to the material outlet device;

fourth means for moving the absorbent member in the elevation direction between a position in which it is separated from the material outlet device and a position in which it is held against the material outlet device; and means for controlling the first, second, third and fourth movement means in at least one cleaning cycle in which substantially simultaneously the scraper member moves and scrapes the material outlet device in a translation movement of the scraper member in the direction of movement of the absorbent member whilst the absorbent member moves and absorbs the material thus scraped.

10. A cleaning system according to claim 9, wherein, in the first geometric relationship, the absorbent member is generally flat in shape and is disposed in the cleaning plane, opposite the material outlet device.

11. A cleaning system according to claim 9 wherein, in the second geometric relationship, the scraper member is disposed so that the absorbent member is positioned between the material outlet device and the scraper member.

12. A cleaning system according to claim 9, wherein the first movement means comprise a runner allowing the translation movement of the scraper member in the direction of movement of the absorbent member.

13. A cleaning system according to claim 9, wherein the second movement means comprise an actuator with an electromagnet.

14. A cleaning system according to claim 9, wherein the absorbent member is in the form of a ribbon of absorbent material and the third movement means comprise a payout reel and a winding reel as well as two guide axes, said two reels being able to cooperate in order to make the ribbon of absorbent material pass between the two guide axes.

15. A cleaning system according to claim 14, wherein the fourth movement means comprise at least one runner allowing translation movement in the elevation direction of at least one of the guide axes.

16. A cleaning system according to claim 14, wherein the fourth movement means comprise at least one eccentric allowing translation movement in the elevation direction of at least one of the guide axes.

17. A cleaning system according to claim 9, wherein the control means provide a cleaning cycle during which:

the fourth movement means are controlled so as to keep the absorbent member separated from the material outlet device;

the third movement means are controlled so as to move the absorbent member in the cleaning plane relative to the material outlet device; and the second movement means are controlled so as to press the scraper member against the absorbent member and the material outlet device.

18. A cleaning system according to claim 9, wherein the control means provide a purge cycle during which:

the fourth movement means are controlled so as to hold the absorbent member against the material outlet device;

the third movement means are controlled so as to move the absorbent member in the cleaning plane relative to the material outlet device; and the second movement means are controlled so as to hold the scraper member separated from the material outlet device.

19. A cleaning system according to claim 9, wherein the control means provide a jet cycle during which:

the fourth movement means are controlled so as to keep the absorbent member separated from the material outlet device; and the second movement means are controlled so as to keep the scraper member separated from the material outlet device.

20. A material jet machine comprising: a cleaning system according to claim 9;

a material jet head comprising at least one material outlet orifice;

means for controlling the material jet function of the material jet head; and purge means;

wherein the purge means is arranged so as to expel material via the material outlet device against the absorbent material, so that the material to be sprayed issuing from a reservoir and/or from the material outlet device is recovered by said absorbent member.

21. A material jet machine according to claim 20 wherein the purge means are able, during a cleaning system purge cycle, to control the expulsion of material continuously by the material outlet device for a predetermined period.

22. A material jet machine according to claim 20 wherein the means of controlling the material jet function are able, during a jet cycle of the cleaning system, to control the isolated execution of the jets of material through the material outlet device at regular intervals during the jet cycle period.

23. Equipment for manufacturing at least one of an electronic device and an information medium, and comprising a cleaning system according to claim 9.

* * * * *